US007416440B2

(12) United States Patent
Homyk et al.

(10) Patent No.: US 7,416,440 B2
(45) Date of Patent: Aug. 26, 2008

(54) MODULAR ELECTRICAL ADAPTER

(75) Inventors: William Alan Homyk, Hopewell Junction, NY (US); John Mazzani, Campbell Hall, NY (US)

(73) Assignee: Consolidated Edison Company of New York, Inc., New York, NY (US)

( * ) Notice: Subject to any disclaimer, the term of this patent is extended or adjusted under 35 U.S.C. 154(b) by 0 days.

(21) Appl. No.: 11/486,270

(22) Filed: Jul. 12, 2006

(65) Prior Publication Data

US 2008/0014800 A1 Jan. 17, 2008

(51) Int. Cl.
*H01R 11/00* (2006.01)

(52) U.S. Cl. ..... 439/502; 439/638; 439/620.29

(58) Field of Classification Search ..... 439/502–504, 439/638, 620.29

See application file for complete search history.

(56) References Cited

U.S. PATENT DOCUMENTS

| | | | | |
|---|---|---|---|---|
| 1,466,110 | A | 8/1923 | Beckwith et al. | |
| 3,225,224 | A | 12/1965 | Rydbeck | |
| 4,731,551 | A | 3/1988 | Gibbs et al. | |
| 4,945,346 | A | 7/1990 | Schiemann | |
| 4,998,095 | A | 3/1991 | Shields | |
| 5,018,991 | A | 5/1991 | Katz et al. | |
| 5,331,283 | A | 7/1994 | Sheldon | |
| 5,726,507 | A | 3/1998 | Tipton | |
| 5,888,098 | A * | 3/1999 | Cheng et al. | 439/620.28 |
| 6,162,098 | A * | 12/2000 | Cheng et al. | 439/620.29 |
| 6,731,217 | B1 | 5/2004 | Warner | |
| 6,744,150 | B2 * | 6/2004 | Rendic | 307/38 |
| 6,767,255 | B1 | 7/2004 | Croswell | |
| 6,805,579 | B2 | 10/2004 | Marchand et al. | |
| 2005/0014412 | A1 * | 1/2005 | Wharton | 439/352 |

OTHER PUBLICATIONS

International Search Report and the Written Opinion of the International Searching Authority, Feb. 4, 2008.

* cited by examiner

*Primary Examiner*—Truc T Nguyen
(74) *Attorney, Agent, or Firm*—Cantor Colburn LLP

(57) ABSTRACT

An electrical adapter for temporarily tapping into an electrical circuit external to the adapter having a first fuse holder member capable of receiving a first fuse holder member of the electrical circuit external to the adapter and a second fuse holder member capable of receiving a second fuse holder member of the electrical circuit external to the adapter. The fuse holder members or other temporary electrical quick disconnect connectors may be connected by cables to a power outlet or may be connected by cables to bare wires that may provide power to another circuit when clamped to the bare wires. When connected to an electrical circuit external to the adapter, the electrical adapter provides a source of electrical power while the electrical circuit external to the adapter is maintained and independently operated.

21 Claims, 5 Drawing Sheets

MODULAR ELECTRICAL ADAPTER

FIELD OF THE INVENTION

The present invention relates to an electrical adapter. More particularly, the invention relates to a modular electrical adapter that has fuse holder members for tapping into an electrical circuit.

BACKGROUND OF THE INVENTION

Devices and techniques for temporarily tapping into an electrical circuit have been commonly used to obtain a source of power from an external electrical circuit at a given location. Typically, these devices and techniques involved cutting into phase conductors and cables, attaching clamps to exposed conductors and taping over or otherwise securing the connections. After tapping into an electrical circuit, removing these temporary devices typically involved further taping and cementing the bare conductors in restoring the circuit to avoid a risk of shock from possible stray voltage of the electrical circuit. This procedure was time-consuming and often performed by users not accustomed to working with electrical circuitry. Accordingly, when this procedure was not performed successfully, it resulted in possible stray voltage, often in public locations.

SUMMARY OF THE INVENTION

The above-identified problems are resolved and a technical advance is achieved in the art by a device and method for enabling users to obtain a temporary source of power from an external electrical circuit using existing or easily installed fuse holders.

An exemplary electrical adapter of the present invention comprises a first electrical disconnect capable of receiving a fuse holder member from an electrical circuit external to the adapter and a second electrical disconnect electrically connected to the first electrical disconnect and capable of receiving a fuse holder member from the electrical circuit external to the adapter.

In accordance with one embodiment of the present invention, an electrical adapter for tapping into an electrical circuit external to the adapter comprises a first fuse holder member; a second fuse holder member electrically connected to the first fuse holder member; and a power outlet electrically connected to said first fuse holder member and said second fuse holder member.

In this embodiment, the power outlet may be electrically connected to a pair of connectors for connecting the power outlet to neutral and ground connections, respectively. The first fuse holder member is capable of receiving a fuse holder member from an electrical circuit external to the adapter and the second fuse holder member is capable of receiving a fuse holder member from the electrical circuit external to the adapter. The connectors may be any type known in the art, for example, alligator clamps. The fuse holder members also may be any type known in the art. For example, the fuse holder members may be threaded and upon engaging each other may create a water resistant or waterproof seal around a fuse. The first fuse holder member and second fuse holder member may be electrically connected to a three-way connector such that a single cable connects to the power outlet. The power outlet may be any type known in the art. For example, the power outlet may be suitable for outdoor use, and may include any type of protective covering to create a water resistant or waterproof seal around the power outlet. External electrical circuits having fuse holder members that can be tapped into using the adapter of the present invention include, but are not limited to, circuits found in the base of street lamps.

In an alternate embodiment, an electrical adapter for tapping into an electrical circuit external to the adapter comprises a first fuse holder member; a second fuse holder member electrically connected to the first fuse holder member; and bare wires electrically connected to said first fuse holder member and said second fuse holder member. The first fuse holder member and second fuse holder member may be electrically connected to a three-way connector such that a single cable connects to the second fuse holder. The cable leading from the second fuse holder may terminate in bare wires covered by a shrink cap. Upon removing the shrink cap, the bare wires may be clamped to a cable of another electrical circuit to provide electrical power to that other circuit.

In accordance with the present invention, a method of tapping into an electrical circuit external to an electrical adapter is also provided. In one embodiment, the method comprises disconnecting a fuse holder in the external electrical circuit, the fuse holder having a first fuse holder member and a second fuse holder member, connecting a first clamp of the electrical adapter to a neutral connection in the circuit, connecting a second clamp of the adapter to a ground connection, connecting a first fuse holder member of the electrical adapter to the first fuse holder member of the external electrical circuit, and connecting a second fuse holder member of the electrical adapter to the second fuse holder connection of the external electrical circuit such that electrical power is provided to a power outlet connected to said first and second fuse holder members of the electrical adapter.

In yet another embodiment, the method of tapping into an electrical circuit external to an electrical adapter comprises disconnecting a fuse holder in the external electrical circuit, the fuse holder having a first fuse holder member and a second fuse holder member, connecting a first fuse holder member of the electrical adapter to the first fuse holder member of the external electrical circuit, and connecting a second fuse holder member of the electrical adapter to the second fuse holder member of the external electrical circuit such that electrical power is provided to bare wires connected to said first and second fuse holder members of the electrical adapter.

The present invention advantageously eliminates the need to cut into an electrical circuit and compromise its insulation. Furthermore, the present invention allows authorized users to quickly and easily obtain access to electrical power and safely restore an electrical circuit that has a fuse holder by eliminating the time-consuming clean-up process and the risk of stray voltage from the electrical circuit.

Other and further aspects of the present invention will become apparent during the course of the following description and by reference to the attached drawings.

DETAILED DESCRIPTION OF THE INVENTION

In the following description, reference is made to the accompanying drawings which form a part hereof, and in which are shown by way of illustration various embodiments in which the invention may be practiced. It is to be understood that other embodiments may be utilized and structural and functional modifications may be made without departing from the scope of the present invention.

Figure 1:
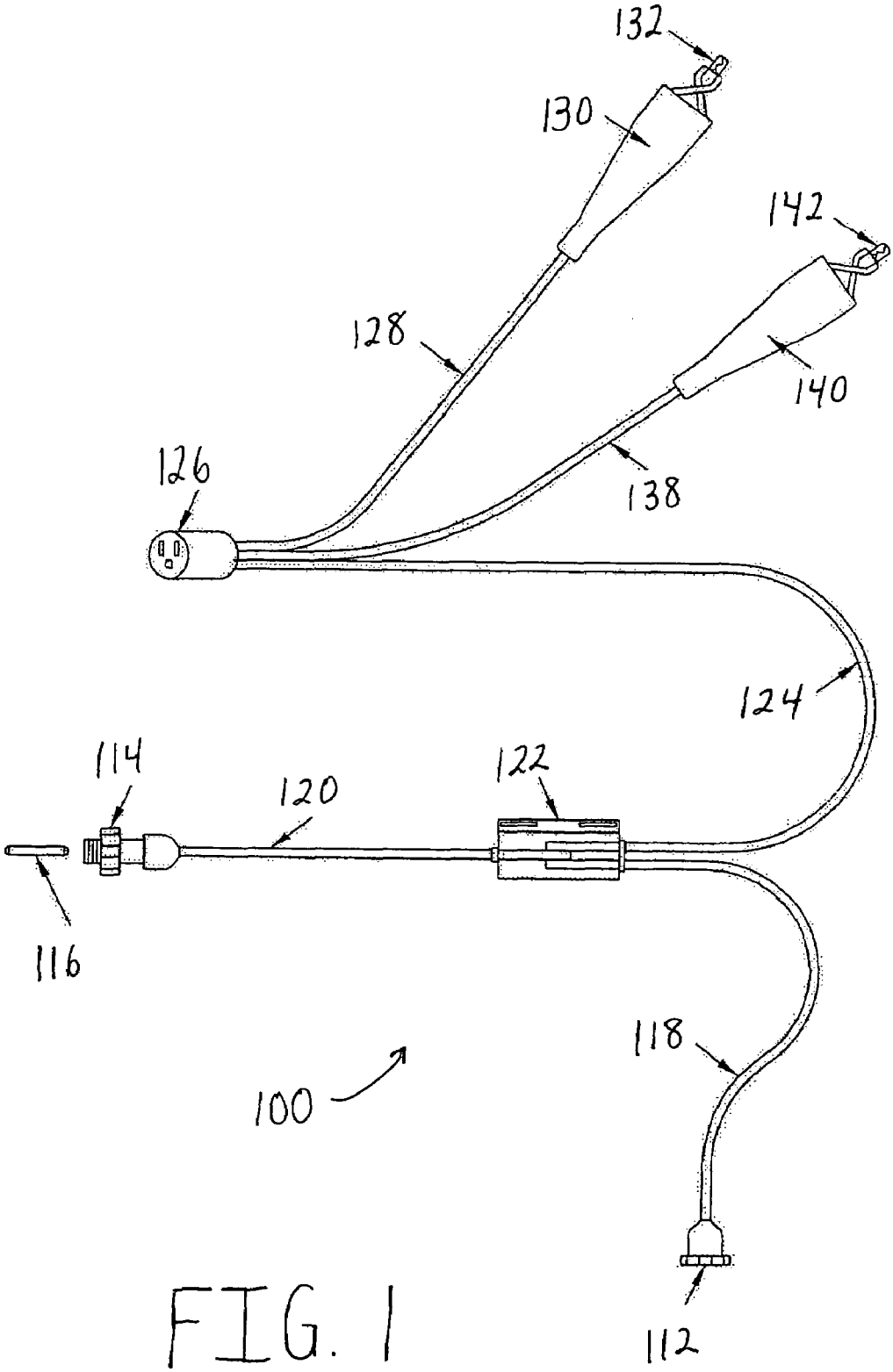
FIG. 1 illustrates an electrical adapter in accordance with one embodiment of the present invention.

Referring now to the drawings, wherein like reference numerals refer to like parts, FIG. 1 is a diagram illustrating an exemplary electrical adapter 100 in accordance with one embodiment of the present invention. As shown in FIG. 1, electrical adapter 100 includes a female fuse holder member 112 and male fuse holder member 114. Fuse 116 fits inside female fuse holder member 112 and male fuse holder member 114. Fuse 116 may also be a solid metal link. Female fuse holder member 112 and male fuse holder member 114 include threaded connectors capable of receiving each other and surrounding fuse 116. The threaded connectors of female fuse holder member 112 and male fuse holder member 114 engage each other to create a water tight seal around fuse 116 for the purpose of storage of fuse 116, such as during transport. Female fuse holder member 112 and male fuse holder member 114 are connected to cables 118 and 120, respectively. The opposing ends of cables 118 and 120 are connected to three-way connector 122. Cable 124 of electrical adapter 100 is connected to three-way connector 122 at one end and at its opposing end cable 124 is connected to power outlet 126. Power outlet 126 may be a female three-prong 120 volt outlet as shown or any other type of outlet known in the art. Power outlet 126 is connected to cables 128 and 138. At the end opposite of its connection to power outlet 126, cable 128 terminates in alligator clamp 132, which is protected by insulating cover 130. Similarly, at the end opposite of its connection to power outlet 126, cable 138 terminates in alligator clamp 142, which is protected by insulating cover 140. It will be appreciated that the cables of the electrical adapter described herein, include a positive or load wire, a neutral wire and a ground wire connection. The alligator clamps discussed herein may alternatively be any type of bolted or other electrical connector known in the art.

Figure 2:
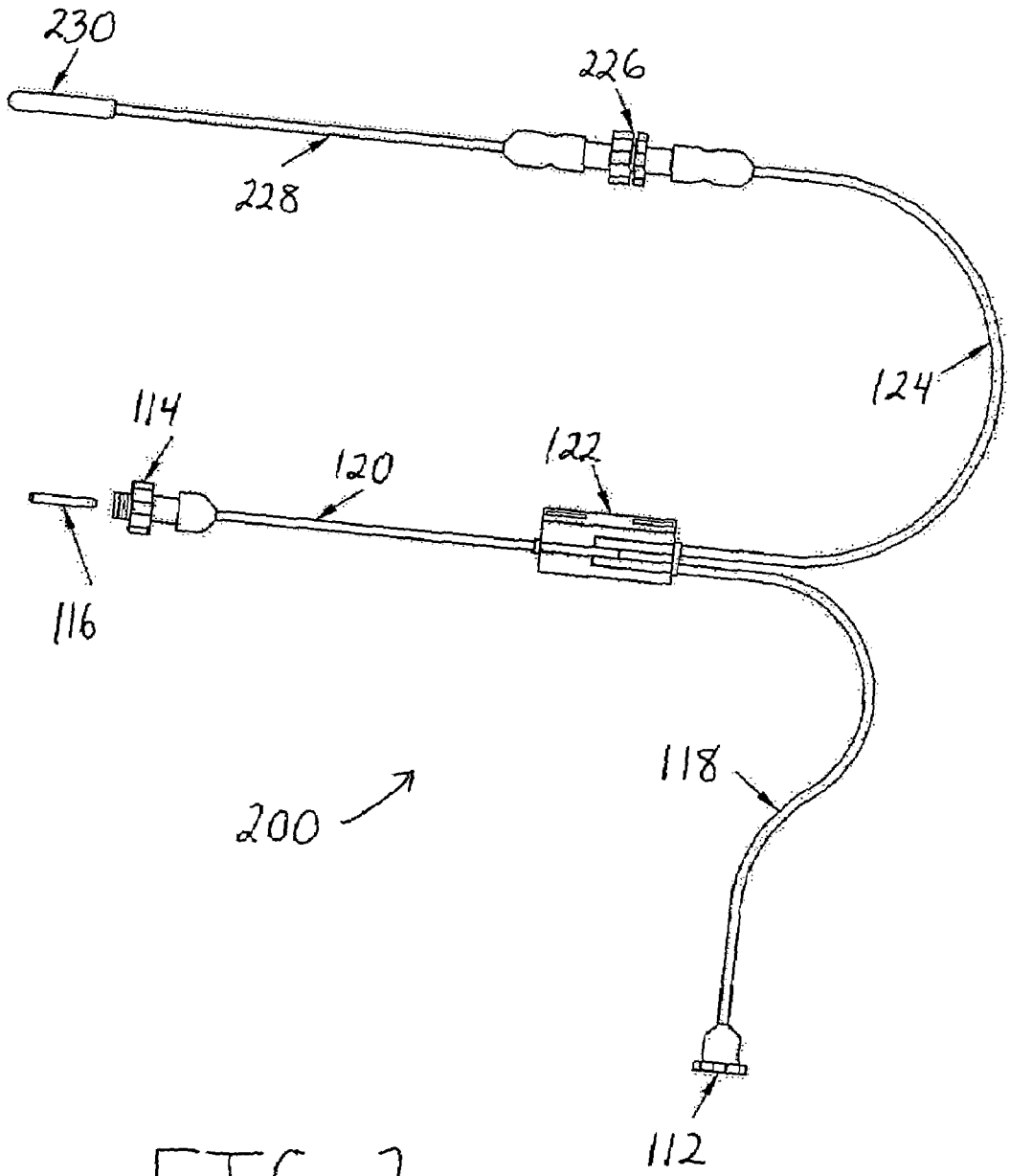
FIG. 2 illustrates an electrical adapter in accordance with another embodiment of the present invention.

FIG. 2 illustrates an exemplary electrical adapter in accordance with another embodiment of the present invention. As illustrated in FIG. 2, electrical adapter 200, like adapter 100 shown in FIG. 1, includes female fuse holder member 112, male fuse holder member 114, fuse 116, cables 118 and 120, three-way connector 122 and cable 124 arranged in the manner discussed above in connection with FIG. 1. At its opposing end, cable 124, rather than being connected to power outlet 126, as shown in FIG. 1, is instead connected to fuse holder 226. Fuse holder 226 includes a female fuse holder member and a male fuse holder member, each of which have threaded connectors capable of receiving each other to create a water tight seal around a fuse (not shown). At the end opposite of its connection to cable 124, fuse holder 226 is connected to cable 228. The other end of cable 228 is connected to shrink cap 230. Shrink cap 230 covers bare wires at the end of cable 228. It will be appreciated that the cables of the electrical adapter described herein include a positive or load wire (also known as a phase or hot wire).

Figure 3A:
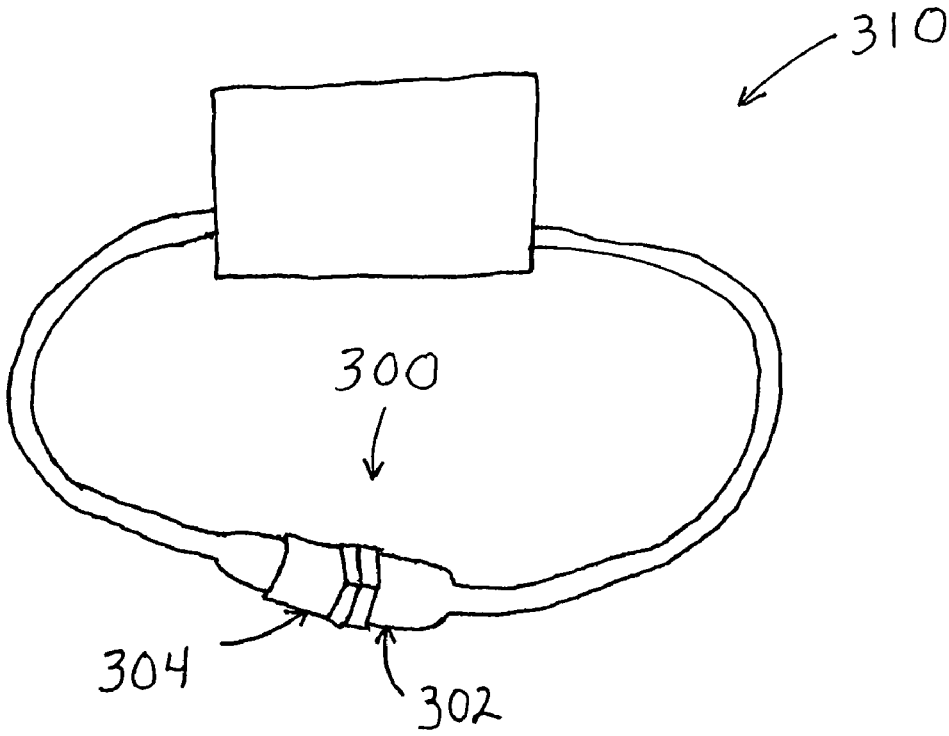
FIGS. 3A and 3B illustrates a typical fuse holder of an external electrical circuit that may be employed with an electrical adapter in accordance with one embodiment of the present invention.
Figure 3B:
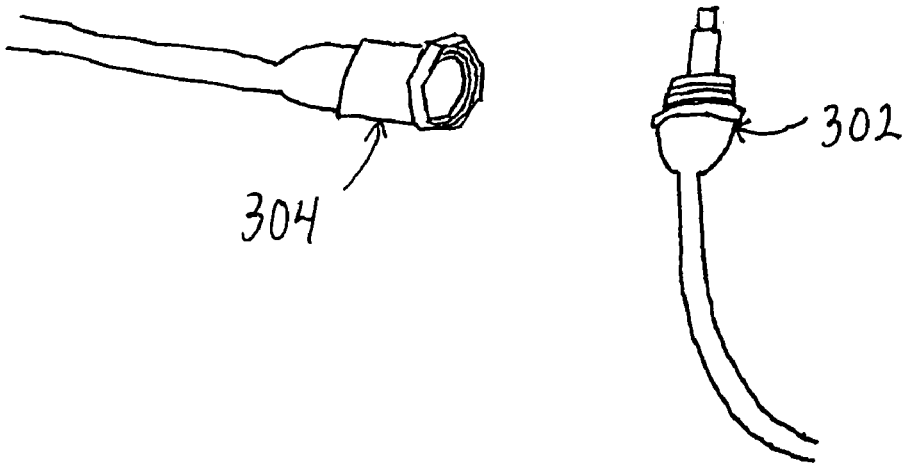

The electrical adapter of the present invention may be used to tap into an external electrical circuit as will be described in detail hereinafter in connection with FIGS. 3A-5. The external electrical circuit is an electrical circuit external to the electrical adapter of the present invention. A user of an electrical adapter of the present invention locates an external electrical circuit 310 comprising fuse holder 300 having male and female members 302 and 304 with threaded connectors, such as those illustrated in FIGS. 3A and 3B. For example, such a fuse holder may be located in an electrical fixture, such as the base of a streetlight. As shown in FIG. 3B, male and female members 302 and 304 of fuse holder 300 are disconnected by unscrewing the threaded connectors of male and female members 302 and 304. By this action, the external circuit is opened and an electrical adapter in accordance with the present invention may be connected to the external circuit, while still maintaining the continuity of the circuit.

Figure 4:
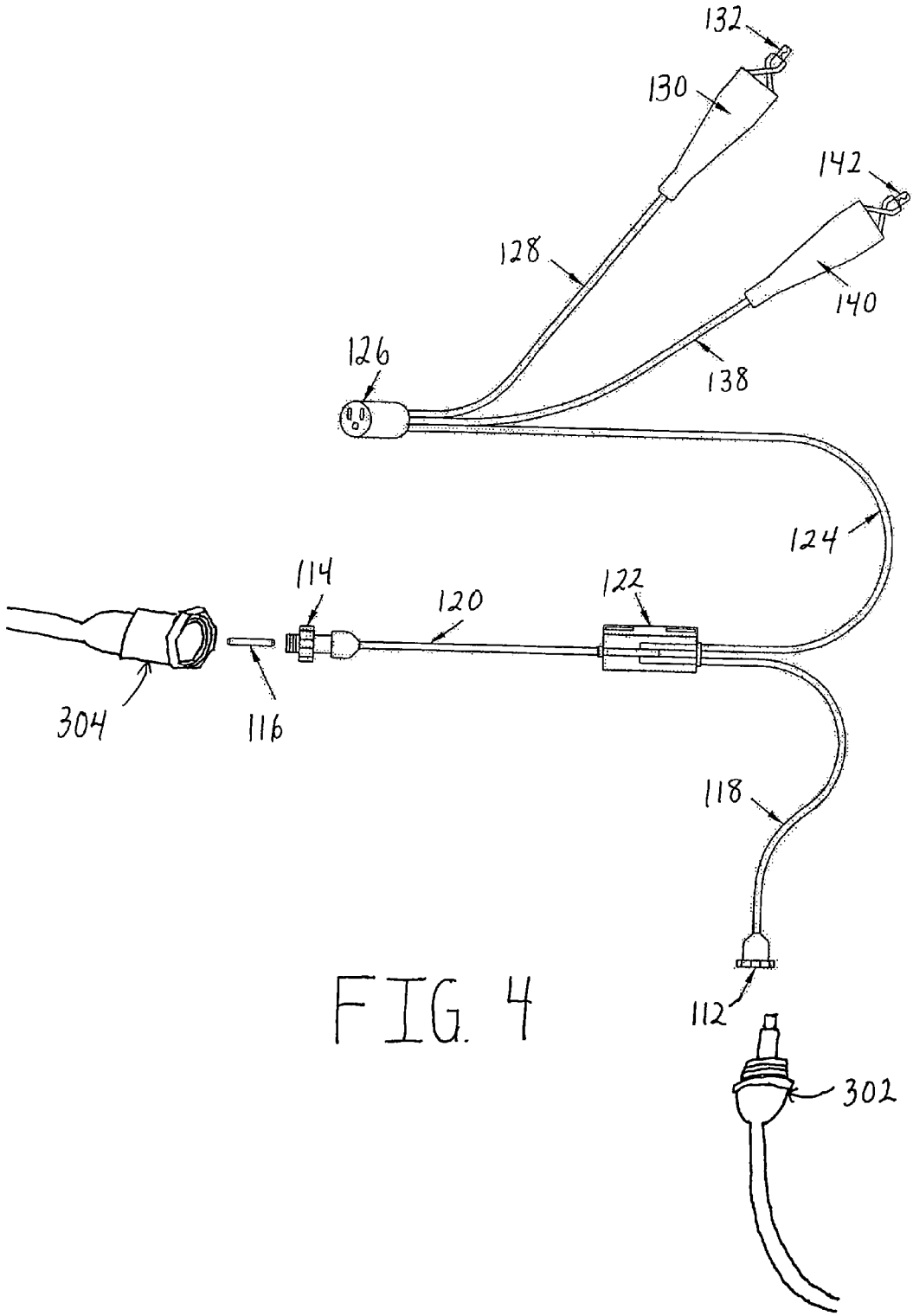
FIG. 4 illustrates the connections made between a typical fuse holder and the electrical adapter of FIG. 1 in accordance with one embodiment of the present invention.

FIG. 4 illustrates exemplary connections that may be made with the electrical adapter of FIG. 1 to tap into an external electrical circuit. It will be understood that the order in which the following connections are made may vary. With reference to FIG. 4, alligator clamp 142 may be connected to a suitable surface (not shown) to form a ground connection. Alligator clamp 132 may be connected to a suitable neutral surface (not shown) such as a neutral cable of the external electrical circuit to form a neutral connection. Female fuse holder member 112 of the electrical adapter of FIG. 1 may be connected to male fuse holder member 302 of an external electrical circuit by screwing the threaded connectors so that female fuse holder member 112 and male fuse holder member 302 engage each other. Male fuse holder member 114 of the electrical adapter of FIG. 1 may be connected to female fuse holder member 304 of the external electrical circuit by screwing the threaded connectors so that male fuse holder member 114 and female fuse holder member 304 engage each other. Upon completion of these connections, the electrical adapter of FIG. 1 creates a circuit in parallel to the external electrical circuit such that electrical power is provided to both power outlet 126 of the electrical adapter of FIG. 1 and to the external electrical circuit. Thus, for example, if the external electrical circuit is a circuit found at the base of a streetlight, by completing the above-described connections, electrical power is provided to both power outlet 126 of the electrical adapter of FIG. 1 and to the lamp of the streetlight.

Figure 5:
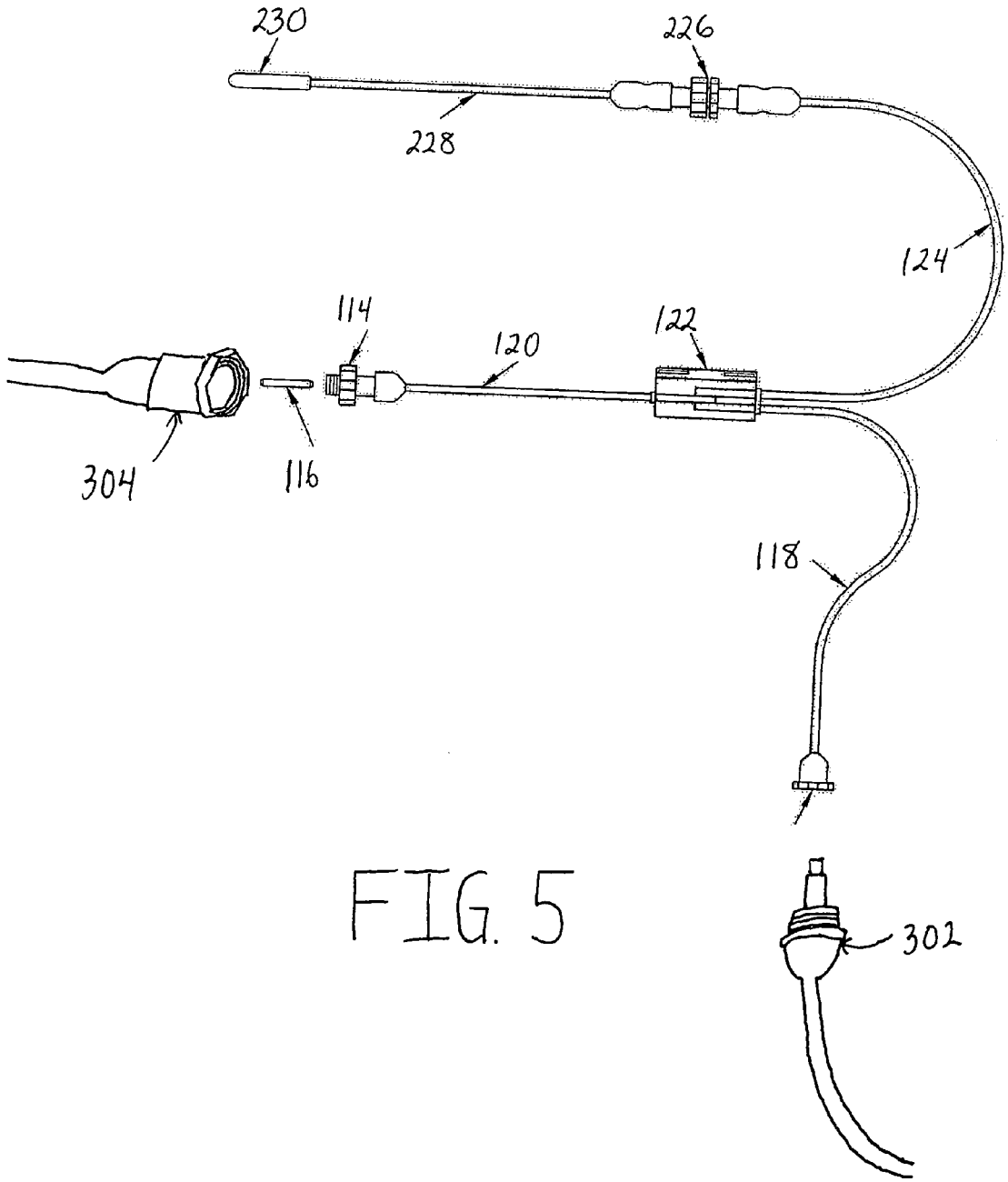
FIG. 5 illustrates the connections made between a typical fuse holder and the electrical adapter of FIG. 2 in accordance with another embodiment of the present invention.

FIG. 5 illustrates exemplary connections that may be made with the electrical adapter of FIG. 2 to tap into an external electrical circuit. In like manner as discussed above in connection with FIG. 4, the fuse holder members of the electrical adapter of FIG. 2 may be connected and engaged with the fuse holder members of an external electrical circuit. Upon completion of these connections, the electrical adapter of FIG. 2 creates a circuit parallel to the external electrical circuit such that electrical power is provided to both the bare wires at the end of cable 228 of the electrical adapter of FIG. 2 and to the external electrical circuit. Shrink cap 230 may be removed to expose the bare wires at the end of cable 228. The bare wires at the end of cable 228 may be clamped to bare wires of another circuit to provide electrical power to that other circuit. The bare wires may be clamped together by any suitable connector and the connection may be covered by a suitable protective cover. The other circuit powered by tapping into an external electrical circuit may be, for example, overhead wires at a construction site. It will be appreciated that an electrical adapter according to the present invention is capable of carrying power sufficient to supply electricity to an entire house.

According to an embodiment of the present invention having cables connecting elements such as the alligator clamps and outlet of the electrical adapter of FIG. 1, the cables may be insulated and capable of outdoor use. Optionally, the exterior of the cables may be color coded so that the cables of the electrical adapter may be easily distinguished from one another. The cables may also be color coded in a manner that suggests the type of connection to be made with that cable. For example, a cable to be connected to a ground connection may be green.

By making the above-described connections between an electrical adapter in accordance with the present invention and an external electrical circuit, an authorized user has tapped into an external electrical circuit without compromising that circuit. For example, engaging the fuse holder members of the external electrical circuit to the fuse holder members of an electrical adapter in accordance with the present invention creates a seal around the fuses held by the fuse holders. Thus, an electrical adapter in accordance with the present invention may be used to tap into an outdoor external electrical circuit.

When an authorized user has completed temporarily obtaining power from an external electrical circuit, the electrical adapter in accordance with the present invention may be easily disconnected from the electrical circuit and the external electrical circuit may be restored in a quick and safe manner. To disconnect the electrical adapter of the present invention from an electrical circuit, the threaded fuse holder members of the electrical device may be unscrewed and detached from the threaded fuse holder members of the fuse holder from the external electrical circuit. Other connections made with the electrical adapter, such as neutral and ground connections made by alligator clamps, may be unclamped thereby removing any of the connections made with the electrical adapter. Finally, the external electrical circuit may be restored by re-connecting the threaded fuse holder members of the fuse holder from the external electrical circuit such that the fuse holder members engage each other to create a seal around the fuse of the external electrical circuit. Upon reconnecting the threaded fuse holder members of the external electrical circuit, the external electrical circuit is completed and current may flow through the external electrical circuit.

It will be appreciated that the fuse holder of the electrical adapter in accordance with the present invention may be any type of fuse holder known in the art. It will also be appreciated that the alligator clamps described in accordance with the present invention may be replaced with bolted or other types of mechanical connectors.

It should be understood that the foregoing description of the invention is intended merely to be illustrative thereof, and that other embodiments, modifications and equivalents may be apparent to those skilled in the art without departing from the present invention.

What is claimed is:

1. An electrical adapter, comprising:

a first electrical disconnect capable of receiving a fuse holder male member from an electrical circuit external to the adapter;

a second electrical disconnect electrically connected to the first electrical disconnect and capable of receiving a fuse holder female member from the electrical circuit external to the adapter; and, a cable having a first end, said cable first end being electrically coupled to and between said first electrical disconnect and said second electrical disconnect.

2. The electrical adapter of claim 1, wherein said first electrical disconnect comprises a first fuse holder member and said second electrical disconnect comprises a second fuse holder member.

3. The electrical adapter of claim 2, further comprising:

a power outlet electrically connected to a cable second end.

4. The electrical adapter of claim 2, further comprising:

bare wires electrically connected to a cable second end.

5. The electrical adapter of claim 2, wherein said first fuse holder member and said second fuse holder member are electrically connected via a three-way connector.

6. The electrical adapter of claim 3, wherein said power outlet is electrically connected to a pair of connectors for connecting said power outlet to neutral and ground connections, respectively.

7. The electrical adapter of claim 3, wherein said power outlet is suitable for outdoor use.

8. The electrical adapter of claim 3, wherein said power outlet is a 3 prong 120 volt power outlet.

9. The electrical adapter of claim 1, wherein said electrical circuit external to the adapter is an electrical circuit located at a based of a streetlight.

10. An electrical adapter for tapping into an electrical circuit external to the adapter, comprising:

a first fuse holder member having a male threaded portion and an outlet opposite said male threaded portion;

a second fuse holder member having a female threaded portion and an outlet opposite said female threaded portion, said second fuse holder outlet being electrically connected to the first fuse holder member outlet; and a power outlet electrically connected between to said first fuse holder member outlet and said second fuse holder member outlet.

11. The electrical adapter of claim 10, wherein said first fuse member and said second fuse holder member are electrically connected via a three-way connector.

12. The electrical adapter of claim 10, wherein said power outlet is electrically connected to a pair of connectors for connecting said power outlet to neutral and ground connections, respectively.

13. The electrical adapter of claim 10, wherein said power outlet is a three-prong 120 volt power outlet.

14. The electrical adapter of claim 10, wherein said first fuse holder member is capable of receiving a fuse holder member from the electrical circuit external to the adapter and said second fuse holder member is capable of receiving a fuse holder member from the electrical circuit external to the adapter.

15. An electrical adapter for tapping into an external electrical circuit having a fuse holder with a male and a female connection, said adapter comprising:

a first fuse holder member adapted to couple with said male connection;

a second fuse holder member adapted to couple with said female connection and electrically connected to the first fuse holder member; and a cable having a first and second end, said cable first end being electrically connected to and between said first fuse holder member and said second fuse holder member.

16. A method of tapping into an electrical circuit external to an electrical adapter, comprising:

disconnecting a fuse holder in the external electrical circuit, the fuse holder having first fuse holder member and a second fuse holder member, connecting a first clamp of the electrical adapter to a neutral connection in the circuit, connecting a second clamp of the electrical adapter to a ground connection, connecting a first fuse holder member of the electrical adapter to the first fuse holder member of the external electrical circuit, and connecting a second fuse holder member of the electrical adapter to the second fuse holder connection of the external electrical circuit such that electrical power is provided to a power outlet connected to said first and second fuse holder members of the electrical adapter.

17. The method of claim 16, wherein said electrical circuit external to the adapter is an electrical circuit at a base of a streetlight.

18. A method of tapping into an electrical circuit external to an electrical adapter, comprising:

disconnecting a fuse holder in the external electrical circuit, the fuse holder having a first fuse holder member and a second fuse holder member, connecting a first fuse holder member of the electrical adapter to the first fuse holder member of the external electrical circuit, and connecting a second fuse holder member of the electrical adapter to the second fuse holder member of the external electrical circuit such that electrical power is provided to bare wires connected to said first and second fuse holder members of the electrical adapter.

19. The method of claim 18, wherein said electrical circuit external to the adapter is an electrical circuit located at a base of a streetlight.

20. The electrical adapter of claim 15 further comprising a power outlet connector directly electrically coupled to said cable second end.

21. An electrical adapter for tapping into an electrical circuit external to the adapter, comprising:

a first fuse holder member;

a second fuse holder member electrically connected to the first fuse holder member;

a three-way connector, wherein said three-way connector is arranged to electrically connect to said first fuse holder member and said second fuse holder member; and, a power outlet electrically connected to said first fuse holder member and said second fuse holder member.

* * * * *